US006152710A

United States Patent [19]

Oh et al.

[11] Patent Number: 6,152,710

[45] Date of Patent: Nov. 28, 2000

[54] DISCHARGE VALVE SYSTEM FOR LINEAR COMPRESSOR

[75] Inventors: Won-Sik Oh, Seoul; Jung-Sik Park, Kwangmyung, both of Rep. of Korea

[73] Assignee: LG Electronics, Inc., Rep. of Korea

[21] Appl. No.: 09/222,658

[22] Filed: Dec. 30, 1998

[30] Foreign Application Priority Data

Dec. 30, 1997 [KR] Rep. of Korea ..... 97/77647
May 12, 1998 [KR] Rep. of Korea ..... 98/17007

[51] Int. Cl.[7] ..... F04B 39/10; F04B 53/10

[52] U.S. Cl. ..... 417/570

[58] Field of Search ..... 417/570, 415, 417/416, 417

[56] References Cited

U.S. PATENT DOCUMENTS

| | | | |
|---|---|---|---|
| 5,680,881 | 10/1997 | Oh | 137/533.19 |
| 5,722,817 | 3/1998 | Park et al. | 417/312 |
| 5,816,783 | 10/1998 | Oshima et al. | 417/415 |
| 5,947,708 | 9/1999 | Park et al. | 417/552 |
| 5,988,994 | 11/1999 | Berchowitz | 417/415 |

*Primary Examiner*—Teresa Walberg
*Assistant Examiner*—Vinod D Patel
*Attorney, Agent, or Firm*—Ostrolenk, Faber, Gerb & Soffen, LLP

[57] ABSTRACT

In a linear compressor including a cylinder having a compression chamber, a piston compressing a gas by a straight reciprocation in the cylinder, and a cylinder head cover covering the compression chamber of the cylinder, and having a discharge valve system and a spring for tightly supporting the discharge valve system toward an end portion of the cylinder, the discharge valve system for a linear compressor capable of minimizing re-expansion resulting from over-compression by smoothly discharging a compressed gas in the compression chamber of the cylinder, simplifying an assembly process and cutting production costs by decreasing a number of components, includes: a valve formed in a disc shape including a plurality of paths of a certain width and depth inwardly from the circumferential surface of the head, a gas discharged from the compression chamber of the cylinder passing through the paths, a diameter of the valve being set similarly to an inside diameter of the cylinder head cover.

5 Claims, 8 Drawing Sheets

DISCHARGE VALVE SYSTEM FOR LINEAR COMPRESSOR

BACKGROUND OF THE INVENTION

1. Field of the Invention

The present invention relates to a linear compressor, and in particular to a discharge valve system for a linear compressor which can minimize re-expansion of the compressor resulting from over-compression by smoothly discharging a compressed gas in a cylinder to a discharge chamber of a cylinder head cover, simplify an assembly process and cut production costs by decreasing a number of components.

2. Description of the Background Art

FIG. 1 is a cross-sectional view illustrating an interior of a conventional linear compressor. The constitution of the linear compressor will now be described.

A cylindrical inner casing 10 is provided in a hermetic vessel 1 in a certain shape connected to a gas suction pipe 0 through which a gas is sucked. A first lamination 15 is connected to one side of an inner circumferential surface of the inner casing 10.

A disc-shaped cover plate 20 with its center portion open is connected to one side of the inner casing 10, and a disc-shaped cover 25 is connected to the other side thereof.

One side of a cylinder 30 forming a compression chamber is connected to a through hole (not shown) at the center portion of the cover plate 20. There is provided a cylinder head cover 90 forming a discharge chamber (S) by covering one side of an empty space of the cylinder 30, and having a discharge valve system 40 and a spring 35 elastically supporting the discharge valve system 40 toward an end portion of the cylinder 30.

In addition, a piston 60 is installed in the cylinder 30 to perform a straight reciprocation, a gas flow path 60*a* being formed inside the piston 60. A second lamination 65 is connected to an outer circumferential surface of the cylinder 30, and is positioned separately from the first lamination 15 at a certain interval.

A magnet paddle 62 performing a straight reciprocation between the first lamination 15 and second lamination 65 is connected to the piston by a connecting body 61, thereby transferring the straight reciprocation to the piston 60.

An inside coil spring 70 is provided between an inner portion of the connecting body 61 and the second lamination 65, and an outside coil spring 75 is provided between an outer portion of the connecting body 61 and an inner portion of the cover 25, thus elastically supporting the piston 60.

A plurality of springs 80 are installed between a bottom surface of the inner casing 10 and the hermetic vessel 1, thereby elastically supporting the inner casing 10.

The operation of the conventional linear compressor will now be described.

First, when power is applied to the compressor, the magnet paddle 62 performs a straight reciprocation between the first lamination 15 and second lamination 65. As a result, the piston 60 straightly reciprocates in the cylinder 30.

A gas sucked into the hermetic vessel 1 through the gas suction pipe 0 passes through the gas flow path 60*a* formed at the center portion of the piston 60, and sucked and compressed in the compression chamber (C) of the cylinder 30. The compressed gas is discharged to the discharge chamber (S) by the discharge valve system 40.

A first embodiment of the discharge valve system 40 provided in the cylinder head cover 90 of the conventional linear compressor will now be described in detail with reference to FIGS. 2 to 3C.

The discharge valve system 40 includes: a disc-shaped head 41 having a discharge hole 42 at its center portion and tightly supported to the end portion of the cylinder 30; a ring-shaped valve 44 with an opening/closing flake 43 inwardly extended, the opening/closing flake 43 opening or closing the discharge hole 42 of the head; and a disc-shaped retainer 45 with its circumferential surface curvedly extended, having a plurality of discharge holes 46 in order to control an opening degree of the opening/closing flake 43, and tightly supporting the valve 44 toward the head 41.

Here, the head 41, valve 44 and retainer 45 are elastically tightly supported by the spring 35 toward the end portion of the cylinder 30.

Reference numeral 63 is a suction valve for inhaling a refrigerant gas into the piston 60. Reference numeral 64 is a cock for supporting the suction valve 63 into the piston 60. Reference numeral 95 is a discharge hole for externally discharging the gas from the discharge chamber (S).

The operation of discharging the gas compressed in the compression chamber (C) by the discharge valve system 40 will now be explained.

When the piston 60 compresses the gas in the compression chamber (C) by a forward movement, the compressed gas pushes the opening/closing flake 43 of the valve 44 through the discharge hole 42 of the head 41 at a certain point, passes through the discharge hole 46 of the retainer 45, and is sucked into the discharge chamber (S) of the cylinder head cover 90. Then, the sucked gas is discharged through the discharge hole 95 of the head cover 90.

Here, the discharge valve system 40 may be pushed by the compressed gas pressure, and thus partially discharge the gas through a gap thereof. However, only a small volume of the gas is discharged therethrough, and the gas is mostly discharged through the discharge hole 42 of the head 41, as described above.

A second embodiment of the discharge valve system 40 will now be described with reference to FIGS. 4A through 6B.

FIGS. 4A and 4B are respectively a perspective view of a head 50 and a cross-sectional view taken along line I–I' in FIG. 4A. FIG. 5 is a plan view of a valve 53. FIGS. 6A and 6B are respectively a perspective view of a retainer 55 and a cross-sectional view taken along line II–II' in FIG. 6A.

The discharge valve system 40 includes the head 50, valve 53 and retainer 55, identically to the first embodiment. As illustrated in FIGS. 4A and 4B, the head 50 is formed in a disc type having a discharge hole 51 at its center portion. A ring-shaped groove 52 is formed between the discharge hole 51 and a circumferential surface of the head 50.

As illustrated in FIG. 5, the valve 53 is formed in a spiral shape having an opening/closing unit 54 opening/closing the discharge hole 51 of the head 50 at its center portion.

As shown in FIGS. 6A and 6B, the retainer 55 is formed in a disc shape having a rounded groove 56 of a certain depth at its one side portion, a plurality of discharge holes 57 being formed in the groove 56.

The operation of discharging the gas compressed in the compression chamber (C) of the cylinder 30 by the discharge valve system 40 according to the second embodiment will now be explained.

When the piston 60 compresses the gas in the compression chamber (C) by a forward movement, the compressed gas pushes the opening/closing unit 54 of the valve 53 through the discharge hole 51 of the head 50 at a certain point, passes through the discharge hole 57 of the retainer 55, and is sucked into the discharge chamber (S) of the cylinder head cover 90. The sucked gas is discharged through the discharge hole 95 of the cylinder head cover 90.

The above-described discharge valve system for the linear compressor has a complicated structure of the head, valve and retainer. Also, the discharge hole of the head is small, and thus the compressed gas is not smoothly discharged and remains in the compression chamber of the cylinder. Therefore, the gas is over-compressed during a next operation, thereby causing re-expansion and reducing efficiency of the compressor.

In addition, an operation area of the discharge valve system to the gas compressed in the compression chamber is large, and thus the discharge valve system tends to be pushed toward the spring. When the discharge valve system is returned to the original place by the spring, it collides with the end portion of the cylinder and the inner circumferential surface of the head cover, thus causing noise and abrasion.

The discharge valve system includes a few components, and thus the assembly process is complicated and the production costs are increased.

SUMMARY OF THE INVENTION

It is therefore an object of the present invention to provide a discharge valve system for a linear compressor which can minimize re-expansion resulting from over-compression by smoothly discharging a gas compressed in a compression chamber of a cylinder, simplify an assembly process and cut production costs by decreasing a number of components.

In order to achieve the above-described object of the present invention, in a linear compressor including a cylinder having a compression chamber; a piston compressing a gas by a straight reciprocation in the cylinder; and a cylinder head cover covering the compression chamber of the cylinder, and having a discharge valve system and a spring tightly supporting the discharge valve system toward an end portion of the cylinder, there is provided the discharge valve system for the linear compressor, including: a valve formed in a disc shape having a plurality of paths of a certain width and depth inwardly from a circumferential surface of the head, the plurality of paths being positioned at regular intervals, a gas discharged from the compression chamber of the cylinder passing through the paths, a diameter of the valve being set similarly to an inside diameter of the cylinder head cover.

BRIEF DESCRIPTION OF THE DRAWINGS

The present invention will become better understood with reference to the accompanying drawings which are given only by way of illustration and thus are not limitative of the present invention, wherein:

FIGS. 4A through 6B illustrate a discharge valve system according to a second embodiment, wherein:

FIG. 4A is a perspective view of a head;

FIG. 5 is a plan view of a valve;

FIG. 6B is a cross-sectional view taken along line II–II' in FIG. 6A;

FIGS. 7A and 7B are cross-sectional views respectively of a discharge valve system unit according to the first embodiment of the present invention, wherein:

FIG. 7A is a state view illustrating a state before a gas in a compression chamber passes through the discharge valve system; and FIG. 7B is a state view illustrating a state when the gas in the compression chamber pushes and passes through the discharge valve system;

FIGS. 8A and 8B illustrate a discharge valve system according to the first embodiment of the present invention, wherein:

FIG. 8A is a perspective view of a head; and

FIG. 8B is a perspective view of a valve;

DETAILED DESCRIPTION OF THE INVENTION

Figure 1:
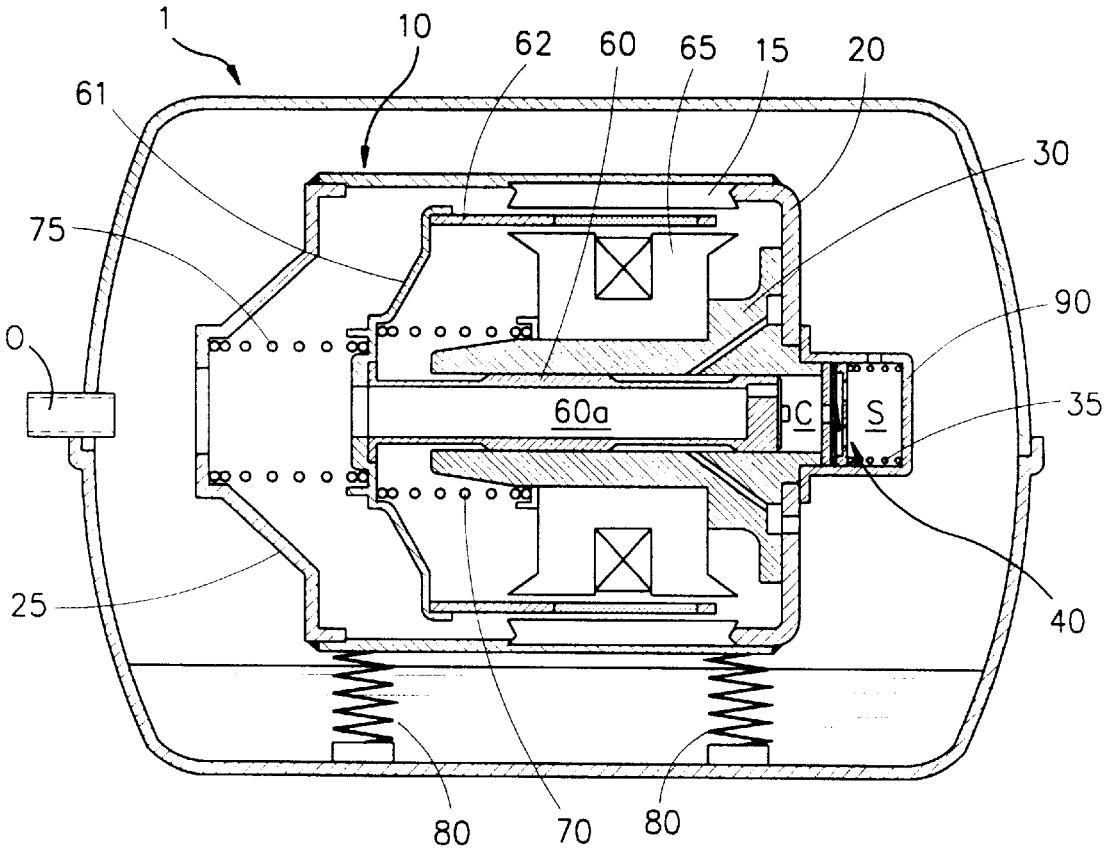
FIG. 1 CONVENTIONAL ART
FIG. 1 is a cross-sectional view of an interior of a general linear compressor.
Figure 2:
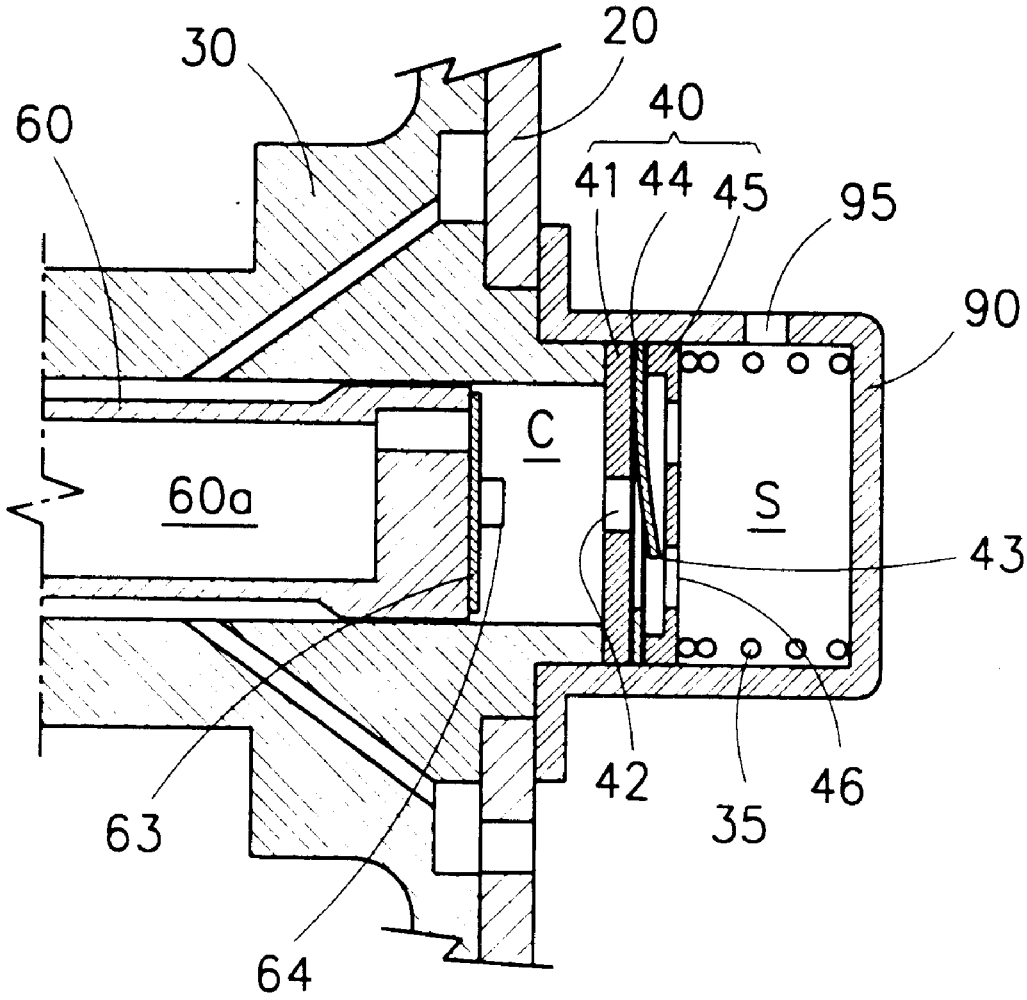
FIG. 2 CONVENTIONAL ART
FIG. 2 is a cross-sectional view of a discharge valve system unit of the conventional linear compressor.
Figure 3A:
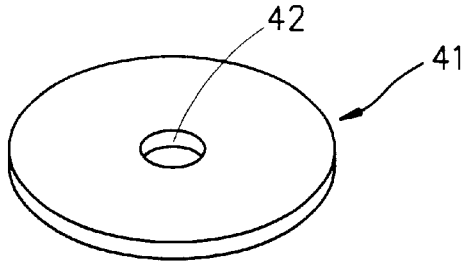
FIG.3A CONVENTIONAL ART
FIGS. 3A to 3C are perspective views respectively of a head, a valve and a retainer of a conventional discharge valve system according to a first embodiment.
Figure 3B:
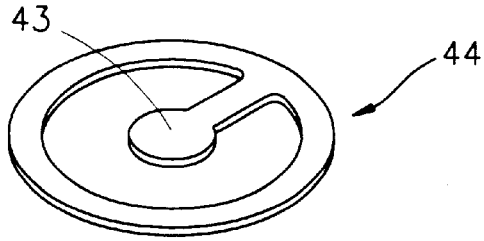
FIG.3B CONVENTIONAL ART
Figure 3C:
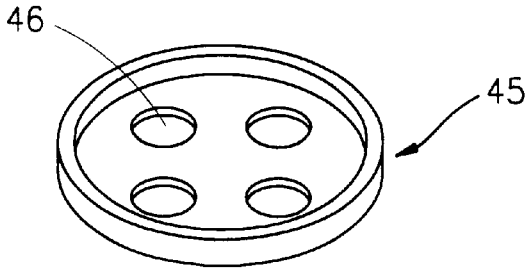
FIG.3C CONVENTIONAL ART
Figure 4A:
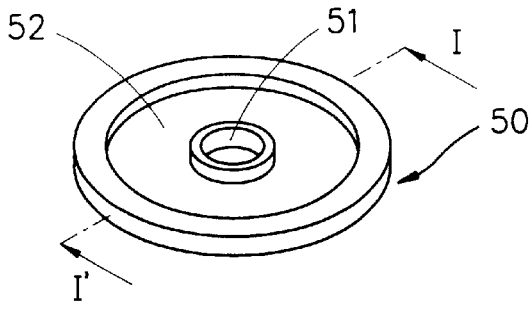
FIG.4A CONVENTIONAL ART
Figure 4B:
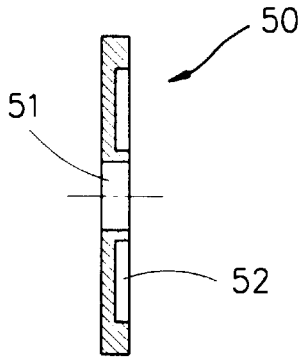
FIG.4B CONVENTIONAL ART
FIG. 4B is a cross-sectional view taken along line I–I' in FIG. 4A.
Figure 5:
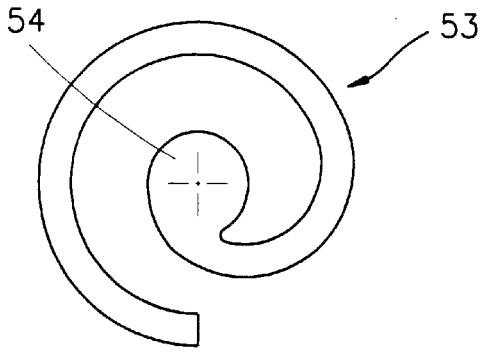
FIG.5 CONVENTIONAL ART
Figure 6A:
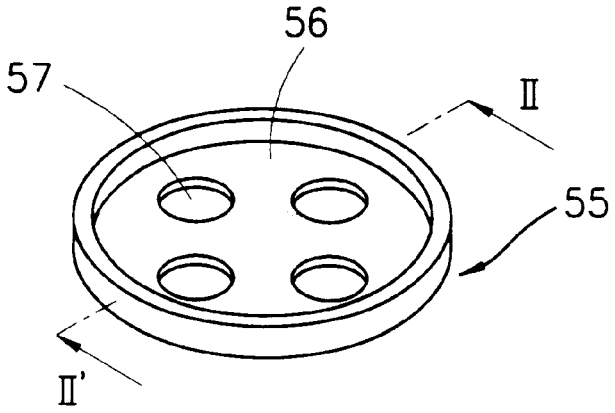
FIG.6A CONVENTIONAL ART
FIG. 6A is a perspective view of a retainer.
Figure 6B:
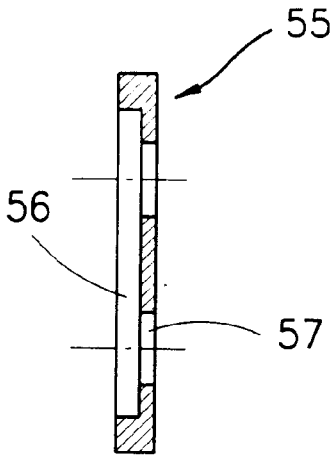
FIG.6B CONVENTIONAL ART

A discharge valve system for a linear compressor in accordance with a first embodiment of the present invention will now be described with reference to the accompanying drawings.

The components identical to those of the conventional linear compressor are provided with the identical reference numerals, and will not be explained.

Figure 7A:
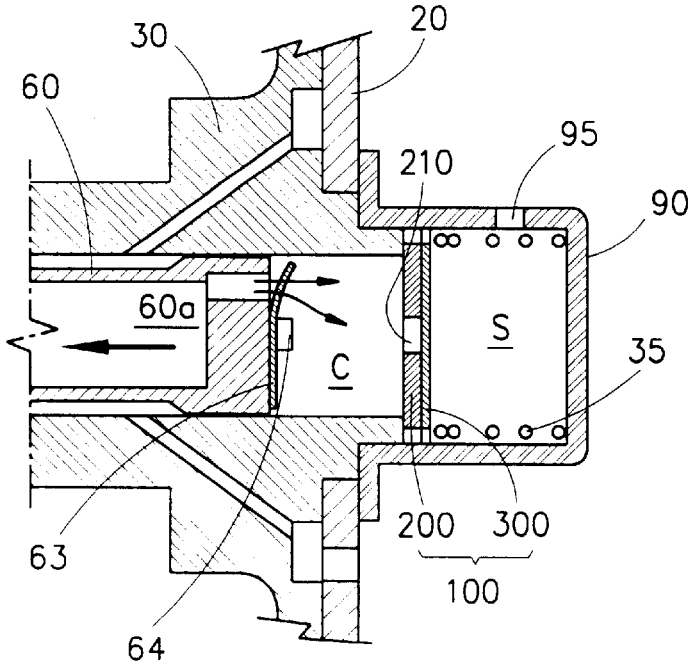
Figure 7B:
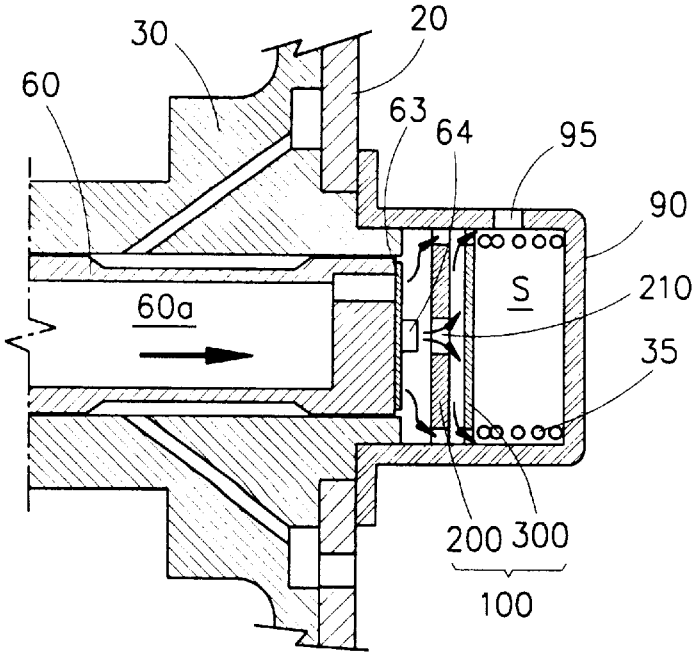
Figure 8A:
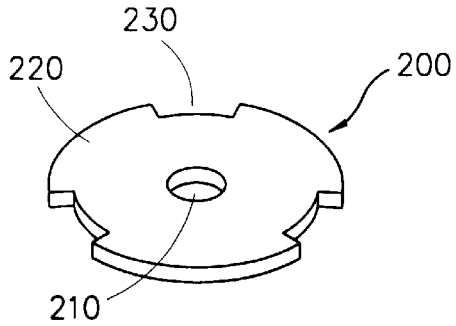
Figure 8B:
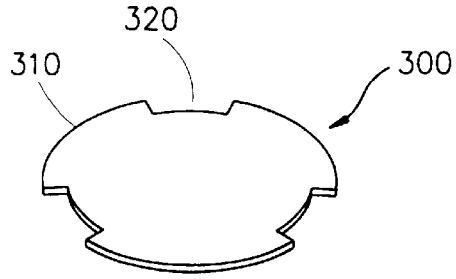

FIGS. 7A and 7B are cross-sectional views respectively of a discharge valve system unit according to the present invention. FIG. 7A illustrate a state before a gas in a compression chamber (C) passes through the discharge valve system 100. FIG. 7B illustrate a state when the gas compressed in the compression chamber (C) pushes and passes through the discharge valve system 100. FIGS. 8A and 8B are perspective views respectively of the discharge valve system according to the present invention.

As illustrated in FIGS. 7A through 8B, the discharge valve system 100 tightly supported to an end portion of the cylinder 30 by a spring 35 provided in the cylinder head cover 90, includes: a head 200 formed in a disc shape having a through hole 210 at its center portion, a plurality of paths being formed of a certain width and depth inwardly from the outer circumferential surface of the head 200 and being positioned at regular intervals, the compressed gas passing through the paths; and a valve 300 formed identically to the head 200 which does not have the through hole 210, and having a plurality of paths 320 through which the compressed gas is discharged.

The head 200 and valve 300 have a similar diameter to an inside diameter of the cylinder head cover 90.

The head 200 and valve 300 may be formed in a single body.

Reference numeral 310 indicates a circumferential surface of the valve.

The operation of discharging the compressed gas by the discharge valve system 100 according to the first embodiment of the present invention will now be described.

When a piston 60 compresses the gas in the compression chamber (C) by a forward movement, the compressed gas exceeds an elastic force of the spring 35 at a certain point, and pushes the head 200 and valve 300 at a certain degree. Thus, the head 200 and valve 300 are separated from the end portion of the cylinder 30, and the compressed gas is discharged to the discharge chamber (S) of the head cover 90 through the paths 230, 320 of the head 200 and valve 300.

The gas which has been discharged to the discharge chamber (S) is discharged through a discharge hole 95 of the cylinder head cover 95.

When the piston 60 performs a backward movement, the head 200 and valve 300 are returned to the original position by the elastic force of the spring 35.

As the gas is compressed and discharged by a repeated reciprocation of the piston 60, the head 200 and valve 300 are repeatedly operated as described above.

Here, when the head 200 and valve 300 are repeatedly pushed and returned, their circumferential surfaces 220, 310 contact an inner circumferential surface of the cylinder head cover 90 and carry out a sliding movement, maintaining their original positions.

The through hole 210 is formed at the center portion of the head 200, which smoothly discharges the compressed gas when the head 200 and valve 300 are temporarily separated, and prevents the head 200 from colliding with a cock 64 for supporting a suction valve 63 to the piston 60.

Figure 9:
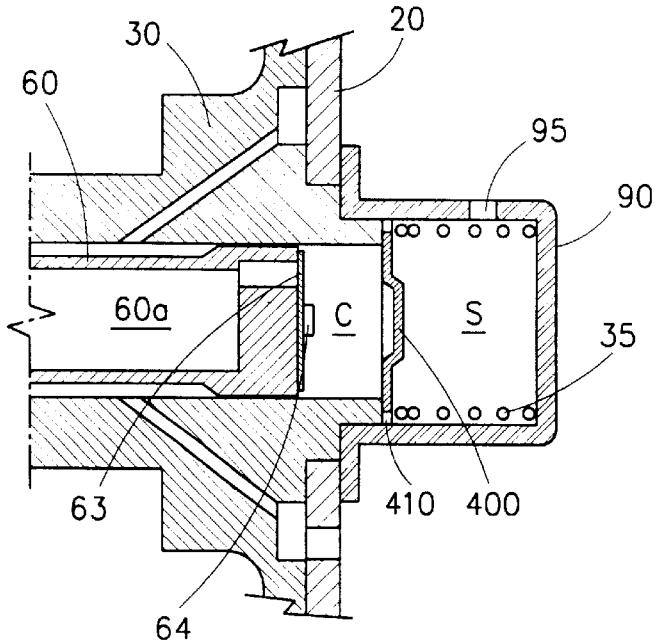
FIG. 9 is a cross-sectional view of a discharge valve system unit according to a second embodiment of the present invention.
Figure 10:
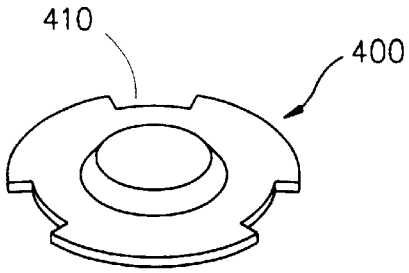
FIG. 10 is a perspective view of a discharge valve system according to the second embodiment of the present invention.
Figure 11:
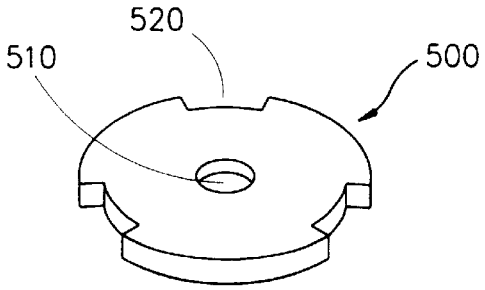
FIG. 11 illustrate another discharge valve system according to the second embodiment of the present invention.

A discharge valve system 100 in accordance with a second embodiment of the present invention will now be described with reference to FIGS. 9 through 11.

The identical components to those according to the first embodiment of the present invention are provided with the identical reference numerals, and will not be described.

The discharge valve system 100 of the second embodiment is formed by removing the head 200 and transforming the valve 300 to be directly supported to the end portion of the cylinder 30. Here, the cock 64 for supporting the suction valve 63 is positioned outside the end portion of the piston 60. In order to prevent the valve 300 from colliding with the cock 64, a center portion of the valve 300 is protruded in a direction as depicted in FIGS. 9 and 10, or a groove 510 is formed at the center portion of the valve 300 as shown in FIG. 11.

The cock 64 does not collide with the valve 300, thereby preventing noise and abrasion.

Reference numerals 410 and 520 indicate the paths through which the gas compressed in the compression chamber (C) pass.

Figure 12:
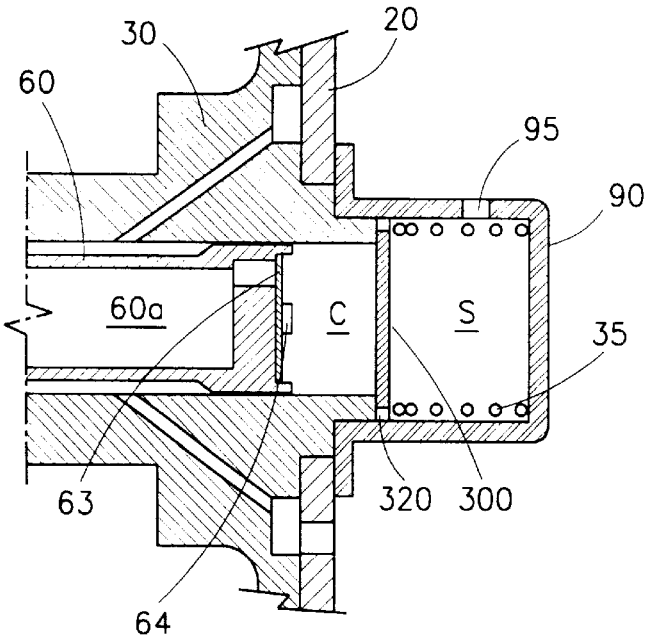
FIG. 12 is a cross-sectional view of the discharge valve system unit according to the present invention, when a cock is positioned inside an end portion of a piston.

According to the second embodiment, the cock 64 is formed outside the end portion of the piston 60. However, as illustrated in FIG. 12, when the cock 64 is formed inside the end portion of the piston 60, the discharge valve system 40 employs the identical valve to the valve 300 of the first embodiment.

The operation of discharging the compressed gas by the discharge valve system of the second embodiment is identical to the first embodiment, and thus will not be explained.

As discussed earlier, the discharge valve system for the linear compressor according to the present invention smoothly discharges the compressed gas in the cylinder to the discharge chamber of the cylinder head cover, thereby minimizing re-expansion of the compressor resulting from over-compression and improving efficiency of the compressor.

In addition, the structure of the discharge valve system is simple, and thus the assembly process is more simplified and the production costs are cut.

As the present invention may be embodied in several forms without departing from the spirit of essential characteristics thereof, it should also be understood that the above-described embodiment is not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a linear compressor including a cylinder having a compression chamber; a piston compressing a gas by straight reciprocation in the cylinder; and a cylinder head cover covering the compression chamber of the cylinder, and having a discharge valve system and a spring tightly supporting the discharge valve system toward an end portion of the cylinder, the discharge valve system comprising:

a disc shape valve including a plurality of paths each of a certain width and depth and recessed inwardly from an inner circumferential surface of the head, said paths being positioned at regular intervals relative to the inner circumferential surface of the head, gas being discharged from the compression chamber of the cylinder passing through the paths.

2. The discharge valve system of claim 1, wherein a groove of a certain depth is formed at a center portion of the valve.

3. The discharge valve system of claim 1, wherein the valve includes a center portion that protrudes in a first direction.

4. The discharge valve system of claim 1, wherein the discharge valve system comprises:

a disc shape head including a plurality of paths, each of a certain width and depth and recessed inwardly from an inner circumferential surface of the cylinder head cover, gas being discharged from the compression chamber passing through the paths, a through hole being formed at a center portion of the head; and a valve tightly supported to one side of the head, identically formed to include the plurality of the paths through which the discharged gas passes, said valve lacking the through hole of the head.

5. The discharge valve system of claim 4, wherein the head and valve are formed in a single body.

* * * * *